US011124729B2

(12) United States Patent
Goyal et al.

(10) Patent No.: US 11,124,729 B2
(45) Date of Patent: Sep. 21, 2021

(54) LUBRICANT COMPOSITION

(71) Applicant: BASF SE, Ludwigshafen (DE)

(72) Inventors: Arjun K. Goyal, West Deptford, NJ (US); Vasudevan Balasubramaniam, Goshen, NY (US)

(73) Assignee: BASF SE, Ludwigshafen (DE)

( * ) Notice: Subject to any disclaimer, the term of this patent is extended or adjusted under 35 U.S.C. 154(b) by 77 days.

(21) Appl. No.: 16/304,525

(22) PCT Filed: Jun. 1, 2017

(86) PCT No.: PCT/US2017/035380
§ 371 (c)(1),
(2) Date: Nov. 26, 2018

(87) PCT Pub. No.: WO2017/210388
PCT Pub. Date: Dec. 7, 2017

(65) Prior Publication Data

US 2019/0292477 A1 Sep. 26, 2019

Related U.S. Application Data

(60) Provisional application No. 62/344,577, filed on Jun. 2, 2016.

(51) Int. Cl.
*C10M 107/34* (2006.01)
*C10N 20/02* (2006.01)
(Continued)

(52) U.S. Cl.
CPC .... *C10M 107/34* (2013.01); *C10M 2207/282* (2013.01); *C10M 2207/2825* (2013.01); *C10M 2209/1033* (2013.01); *C10M 2209/1045* (2013.01); *C10M 2209/1055* (2013.01); *C10M 2209/1075* (2013.01); *C10N 2020/02* (2013.01);
(Continued)

(58) Field of Classification Search
CPC ..... C10M 107/34; C10M 2209/1033; C10M 2209/1075; C10M 2209/105; C10M 2209/1055
See application file for complete search history.

(56) References Cited

U.S. PATENT DOCUMENTS 6,387,854 B1 * 5/2002 Sedelmeier ..... C10M 169/02 508/579
2006/0178279 A1 8/2006 Sullivan et al.
(Continued)

FOREIGN PATENT DOCUMENTS

DE 10 2005 011 776 9/2006
WO 02/077135 10/2002

OTHER PUBLICATIONS

CSt to SUS Conversion Chart.*
(Continued)

*Primary Examiner* — Ellen M McAvoy
(74) *Attorney, Agent, or Firm* — Lowenstein Sandler LLP

(57) ABSTRACT

A lubricant composition includes a polyalkylene glycol base oil component in an amount of at least about 60 parts by weight based on 100 parts by weight of the lubricant composition. The lubricant composition has a kinematic viscosity at 100° C. of from about 4 to about 50 cSt and a kinematic viscosity at 40° C. of from about 20 to about 700 cSt, each measured in accordance with ASTM D445.

18 Claims, 4 Drawing Sheets

(51) Int. Cl.

| | |
|---|---|
| *C10N 30/02* | (2006.01) |
| *C10N 30/06* | (2006.01) |
| *C10N 30/00* | (2006.01) |
| *C10N 40/02* | (2006.01) |
| *C10N 40/04* | (2006.01) |

(52) U.S. Cl.
CPC ..... *C10N 2030/02* (2013.01); *C10N 2030/06* (2013.01); *C10N 2030/54* (2020.05); *C10N 2040/02* (2013.01); *C10N 2040/04* (2013.01); *C10N 2040/042* (2020.05); *C10N 2040/044* (2020.05)

(56) References Cited

U.S. PATENT DOCUMENTS

2007/0004606 A1* 1/2007 da Costa ..... C10M 169/044 508/579
2008/0312113 A1* 12/2008 Beatty ..... C10M 107/34 508/162
2010/0204075 A1* 8/2010 da Costa ..... C10M 111/02 508/579
2011/0039739 A1* 2/2011 Greaves ..... C10M 169/04 508/428
2011/0039741 A1* 2/2011 Thoen ..... C10M 133/16 508/476
2012/0108482 A1* 5/2012 Greaves ..... C10M 111/04 508/579
2013/0102507 A1 4/2013 Thoen et al.
2013/0157909 A1* 6/2013 Greaves ..... C10M 169/04 508/282
2013/0244917 A1* 9/2013 Obrecht ..... C10M 107/24 508/444
2013/0270049 A1* 10/2013 Sherman ..... C08K 5/053 188/266
2014/0018272 A1 1/2014 Thoea et al.
2015/0126419 A1* 5/2015 Lerasle ..... C10M 161/00 508/364
2015/0141308 A1* 5/2015 Greaves ..... C08G 65/2606 508/579
2016/0060561 A1* 3/2016 Greaves ..... C10M 145/30 508/579
2016/0068780 A1* 3/2016 Greaves ..... C10M 145/32 508/579
2016/0083671 A1* 3/2016 Yao ..... C10M 133/10 508/296
2017/0226442 A1* 8/2017 Sanson ..... C10M 107/34
2019/0071616 A1* 3/2019 Broutin ..... C10M 135/18
2020/0017792 A1* 1/2020 Sherman ..... C10M 107/34

OTHER PUBLICATIONS

International Search Report for International Application No. PCT/US2017/035380 dated Sep. 18, 2017, 4 pgs.
Dr. Yaokun (Ken) Han, R&D / TS&D Dow Performance Fluids "Oil Soluble Polyalkylene Glycols, A new Group V Solution Oil," Dow Chemical Company, 36 pages, dated Jan. 6, 2014, retrieved from https://pdfslide.tips/documents/oil-soluble-polyalkylene-glycols-a-new-group-v-4-dow-ospa-new2014-01-06visc,osity.html.
"Synalox 40-D Base Fluids High Performance Polyalkylene Glycol Fluids," Lubricants, Dow, 6 pages, published Sep. 2006.
"Synalox 50-B Series", Technical Data Sheet, The Dow Chemical Company, 2 pages, published Jul. 2, 2008, retrieved from https://studylib.net/doc/18735739/synalox%E2%84%A2-50-b-series—the-dow-chemical-company# on Jun. 23, 2020.

* cited by examiner

LUBRICANT COMPOSITION

CROSS-REFERENCE TO RELATED APPLICATIONS

This application is a national phase entry under 35 U.S.C. § 371 of International Application No. PCT/US2017/035380, filed on Jun. 1, 2017, which claims the benefit of priority of Application No. 62/344,577, filed on Jun. 2, 2016. The contents of these applications are hereby incorporated by reference herein in their entirety.

FIELD OF THE DISCLOSURE

The present disclosure generally relates to a lubricant composition.

BACKGROUND OF THE DISCLOSURE

Lubricant compositions are typically required to have a number of performance characteristics associated with the lubricant composition itself and/or with the performance of the equipment in which the lubricant composition is to be used (e.g. vehicles). Recently, market forces and governmental regulations have placed a renewed emphasis on fuel efficiency for vehicles. Thus, there remains an opportunity to develop a lubricant composition with improved fuel efficiency.

SUMMARY OF THE DISCLOSURE AND ADVANTAGES

The present disclosure provides a lubricant composition. The lubricant composition includes a polyalkylene glycol base oil component in an amount of at least about 60 parts by weight based on 100 parts by weight of the lubricant composition. The lubricant composition has a kinematic viscosity at 100° C. of from about 4 to about 50 cSt and a kinematic viscosity at 40° C. of from about 20 to about 700 cSt, each measured in accordance with ASTM D445. The lubricant composition is useful for increasing the fuel efficiency of a vehicle.

DETAILED DESCRIPTION OF THE DISCLOSURE

Figure 1A:
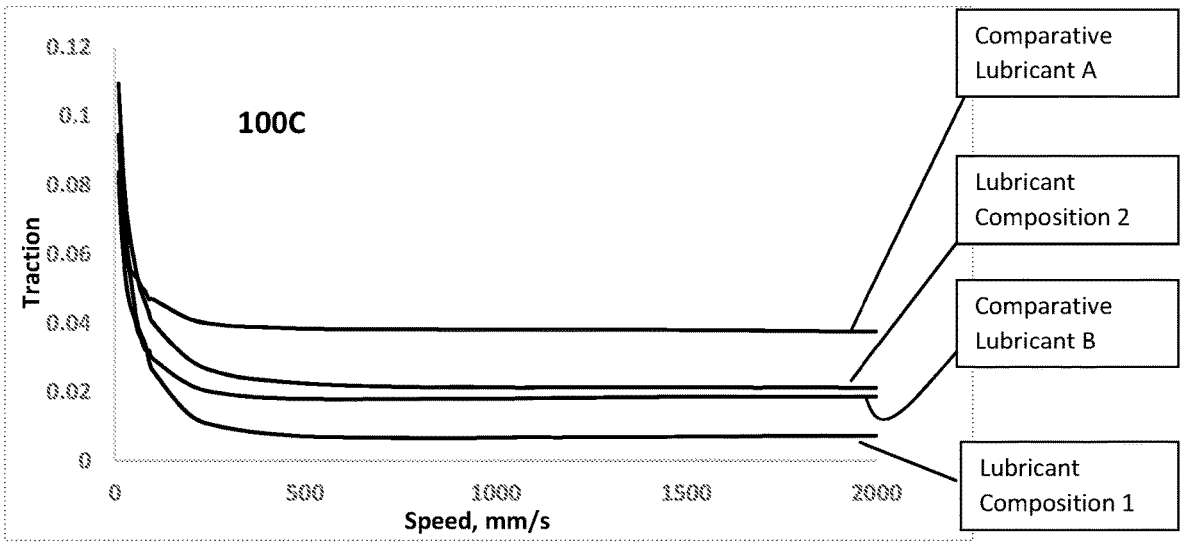
FIG. 1A is a line graph illustrating traction coefficient data for certain embodiments of the lubricant composition.

The present disclosure provides a lubricant composition. The lubricant composition can be utilized in a variety of lubricating applications, and is especially useful as a lubricant for axles, transmissions (manual or automatic), transfer cases, power take off, transaxles, and bearings/wheels.

The lubricant composition includes a polyalkylene glycol base oil component. Typically, the polyalkylene glycol base oil component includes one or more polyalkylene glycols. For example, the polyalkylene glycol base oil component may include, one, two, three, four, or more polyalkylene glycols.

In certain embodiments, the lubricant composition includes the polyalkylene glycol base oil component from about 60 to about 98 parts by weight based on 100 parts by weight of the polyalkylene glycol base oil component. Alternatively, the lubricant composition includes the polyalkylene glycol base oil component in an amount of from about 65 to about 98, from about 70 to about 98, from about 75 to about 98, from about 80 to about 98, from about 85 to about 98, or from about 95 to about 98, parts by weight based on 100 parts by weight of the lubricant composition. Alternatively, the lubricant composition includes the polyalkylene glycol base oil component in an amount of from about 60 to about 95, from about 65 to about 90, from about 70 to about 90, or from about 70 to about 90, parts by weight based on 100 parts by weight of the lubricant composition.

The lubricant composition has a kinematic viscosity at 100° C. of from about 4 to about 50 cSt when measured in accordance with ASTM D445. It is to be understood that for the purpose of this disclosure, any reference to kinematic viscosity is the kinematic viscosity as measured by ASTM D445. In certain embodiments, the lubricant composition has a kinematic viscosity at 100° C. of from about 4 to about 45, from about 5 to about 40, from about 5 to about 35, from about 5 to about 30, from about 5 to about 25, from about 5 to about 20, from about 5 to about 15, or from about 5 to about 10, cSt.

The lubricant composition also has a kinematic viscosity at 40° C. of from about 20 to about 700 cSt. In certain embodiments, the lubricant composition has a kinematic viscosity at 40° C. of from about 20 to about 660, from about 20 to about 620, from about 20 to about 580, from about 20 to about 540, from about 20 to about 500, from about 20 to about 460, from about 20 to about 420, from about 20 to about 380, from about 20 to about 340, from about 20 to about 300, from about 20 to about 260, from about 20 to about 220, from about 20 to about 180, from about 20 to about 140, from about 20 to about 100, or from about 20 to about 60, cSt. In other embodiments, the lubricant composition has a kinematic viscosity at 40° C. of from about 20 to about 100, from about 30 to about 90, from about 40 to about 80, or from about 50 to about 70, cSt.

The lubricant composition typically has a viscosity index of from about 170 to about 250 as measured in accordance with ASTM D2270. Alternatively, the lubricant composition may have a viscosity index of from about 180 to about 240, from about 190 to about 230, or from about 200 to about 220. It is to be understood that for the purpose of this disclosure, any reference to viscosity index is the viscosity index as measured by ASTM D2270.

The kinematic viscosity and the viscosity index of the lubricant composition results in the lubricant composition being particularly useful for lubricating an axle of a vehicle, such that the lubricant composition may also be referred to as an axle lubricant. Similarly, the kinematic viscosity and the viscosity index of the lubricant composition results in the lubricant composition being particularly useful for lubricating transmissions (manual or automatic), transfer cases, transaxles, power take off (PTO), and bearings/wheels. In addition, persons of skill in the art will also appreciate that the kinematic viscosity of the lubricant composition may make the lubricant composition unsuitable for some applications, such as rotary screw compressor lubricants.

In certain embodiments, the lubricant composition is essentially free of Type I, II, III, and IV base oils, as classified according to the American Petroleum Institute (API) Base Oil Interchangeability Guidelines. In the context of this disclosure, "essentially free of Type I, II, III, and IV base oils" means that the lubricant composition includes less than a combined total of about 5 parts by weight of Type I, II, III, and IV base oils, based on 100 parts by weight of the lubricant composition. Alternatively, "essentially free of Type I, II, III, and IV base oils" means that the lubricant composition includes less than a combined total of about 4, about 3, about 2, or about 1, parts by weight of Type I, II, III, and IV base oils, based on 100 parts by weight of the lubricant composition. As one example, the lubricant composition may still be essentially free of Type I, II, III, and IV base oils and contain about 4 parts by weight of one or more of these oils when one of the additives (described further below) included in the lubricant composition is dispersed in a Type I, II, III, and/or IV base oil.

Referring back to the polyalkylene glycol base oil component, in certain embodiments, the polyalkylene glycol base oil component is water-soluble. In these embodiments with the water-soluble polyalkylene glycol base oil component, the polyalkylene glycol base oil component includes a first polyalkylene glycol and a second polyalkylene glycol. Generally, both the first and second polyalkylene glycols are random copolymers formed from the reaction product of ethylene oxide and propylene oxide. Although the ratio of ethylene oxide relative to propylene oxide used to form the first and second polyalkylene glycols may vary, the amount of ethylene oxide is sufficient to render the first and second polyalkylene glycols water-soluble.

Typically, the first polyalkylene glycol has a kinematic viscosity at 100° C. of from about 2 to about 70 cSt and a kinematic viscosity at 40° C. of from about 5 to about 200 cSt. Similarly, the second polyalkylene glycol typically has a kinematic viscosity at 100° C. of from about 50 to about 220 cSt and a kinematic viscosity at 40° C. of from about 150 to about 1,300 cSt. In general, the second polyalkylene glycol has a kinematic viscosity that is greater than the kinematic viscosity of the first polyalkylene glycol at 100° C. and 40° C. In these embodiments, the blend of the first and second polyalkylene glycols typically establish the kinematic viscosity and the viscosity index of the lubricant composition as described above.

In certain embodiments, the first polyalkylene glycol has a kinematic viscosity at 100° C. of from about 2 to about 65, from about 2 to about 60, from about 2 to about 55, from about 2 to about 50, from about 2 to about 45, from about 2 to about 40, from about 2 to about 35, from about 2 to about 30, from about 2 to about 25, from about 2 to about 20, from about 2 to about 15, or from about 2 to about 10, cSt.

In certain embodiments, the first polyalkylene glycol has a kinematic viscosity at 40° C. of from about 5 to about 180, from about 5 to about 160, from about 5 to about 140, from about 5 to about 120, from about 5 to about 100, from about 5 to about 80, from about 5 to about 60, from about 5 to about 40, or about 20, cSt.

In certain embodiments, the second polyalkylene glycol has a kinematic viscosity at 40° C. of from about 160 to about 1,300, from about 300 to about 1,250, from about 450 to about 1,200, from about 600 to about 1,150, or from about 750 to about 1,000, cSt.

In certain embodiments, the second polyalkylene glycol has a kinematic viscosity at 100° C. of from about 5 to about 180, from about 5 to about 160, from about 5 to about 140, from about 5 to about 120, from about 5 to about 100, from about 5 to about 80, from about 5 to about 60, from about 5 to about 40, from about 10 to about 60, from about 10 to about 50, or about 20, cSt.

In one embodiment, the first polyalkylene glycol has a kinematic viscosity at 100° C. of from about 2 to about 30 cSt and a kinematic viscosity at 40° C. of from about 10 to about 50 cSt. In addition, the second polyalkylene glycol has a kinematic viscosity at 100° C. of from about 120 to about 200 cSt and a kinematic viscosity at 40° C. of from about 800 to about 1,200 cSt.

Although not required, the lubricant composition may include the first polyalkylene glycol in an amount of from about 50 to about 85 parts by weight based on 100 parts by weight of the lubricant composition. Alternatively, the lubricant composition may include the first polyalkylene glycol in an amount of from about 55 to about 85, from about 60 to about 85, from about 65 to about 85, from about 70 to about 85, from about 75 to about 85, or about 75, parts by weight based on 100 parts by weight of the lubricant composition.

The lubricant composition may further include the second polyalkylene glycol in an amount of from about 5 to about 35 parts by weight based on 100 parts by weight of the lubricant composition. Alternatively, the lubricant composition may include the second polyalkylene glycol in an amount of from about 5 to about 35, from about 10 to about 30, from about 10 to about 25, from about 10 to about 20, or about 15, parts by weight based on 100 parts by weight of the lubricant composition.

Referring back to the polyalkylene glycol base oil component, in certain embodiments, the polyalkylene glycol base oil component is water-insoluble. In these embodiments with the water-insoluble polyalkylene glycol base oil component, the polyalkylene glycol base oil component includes a third polyalkylene glycol and a fourth polyalkylene glycol. Generally, both the third and fourth polyalkylene glycols are homopolymers formed from the reaction product of propylene oxide. Because the third and fourth polyalkylene glycols are homopolymers formed from the reaction product of propylene oxide, the third and forth polyalkylene glycols are typically considered to be water-insoluble. In addition, it is to be appreciated that the designation of "the third" and "the fourth" polyalkylene glycols does not require a total of three or four polyalkylene glycols. Instead, "the third" and "the fourth" are terms of convenience utilized to distinguish the polyalkylene glycols in the water-insoluble embodiments from the polyalkylene glycols utilized in the water-soluble embodiments (i.e., the first and second polyalkylene glycols).

Typically, the third polyalkylene glycol has a kinematic viscosity at 100° C. of from about 2 to about 15 cSt and a kinematic viscosity at 40° C. of from about 15 to about 70 cSt. Similarly, the fourth polyalkylene glycol typically has a kinematic viscosity at 100° C. of from about 10 to about 50 cSt and a kinematic viscosity at 40° C. of from about 60 to about 250 cSt. In general, the fourth polyalkylene glycol has a kinematic viscosity that is greater than the kinematic viscosity of the third polyalkylene glycol at 100° C. and 40° C. In these embodiments, the blend of the third and fourth polyalkylene glycols typically establish the kinematic viscosity and viscosity index of the lubricant composition as described above.

In certain embodiments, the third polyalkylene glycol has a kinematic viscosity at 100° C. of from about 2 to about 12, from about 3 to about 11, from about 4 to about 10, from about 5 to about 9, or from about 6 to about 8, cSt.

In certain embodiments, the third polyalkylene glycol has a kinematic viscosity at 40° C. of from about 15 to about 65, from about 15 to about 60, from about 20 to about 55, from about 20 to about 50, from about 20 to about 45, or from about 25 to about 40, cSt.

In certain embodiments, the fourth polyalkylene glycol has a kinematic viscosity at 100° C. of from about 10 to about 45, from about 10 to about 40, from about 10 to about 35, from about 10 to about 30, from about 10 to about 25, or from about 15 to about 25, cSt.

In certain embodiments, the fourth polyalkylene glycol has a kinematic viscosity at 40° C. of from about 60 to about 240, from about 70 to about 220, from about 75 to about 200, from about 80 to about 180, from about 85 to about 160, from about 90 to about 155, from about 95 to about 150, from about 100 to about 145, from about 105 to about 140, or from about 110 to about 135, cSt.

In one embodiment, the third polyalkylene glycol has a kinematic viscosity at 100° C. of from about 2 to about 10 cSt and a kinematic viscosity at 40° C. of from about 15 to about 35 cSt. In addition, the fourth polyalkylene glycol has a kinematic viscosity at 100° C. of from about 15 to about 35 cSt and a kinematic viscosity at 40° C. of from about 80 to about 160 cSt.

Although not required, the lubricant composition may include the third polyalkylene glycol in an amount of from about 5 to about 40 parts by weight based on 100 parts by weight of the lubricant composition. Alternatively, the lubricant composition may include the third polyalkylene glycol in an amount of from about 10 to about 35, from about 15 to about 30, or from about 20 to about 25, parts by weight based on 100 parts by weight of the lubricant composition.

The lubricant composition may further include the fourth polyalkylene glycol in an amount of from about 40 to about 75 parts by weight based on 100 parts by weight of the lubricant composition. Alternatively, the lubricant composition may include the fourth polyalkylene glycol in an amount of from about 45 to about 75, from about 50 to about 70, or from about 55 to about 65, parts by weight based on 100 parts by weight of the lubricant composition.

In embodiments when the polyalkylene glycol base oil component is water-insoluble, the lubricant composition may further include an ester base oil. In addition to being a base oil, the ester base oil may also dissolve and/or disperse the additive package (described further below). Typically, the ester is formed from monocarboxylic acids, dicarboxylic acids, or polycarboxylic acids with one or more alcohols. Generally, the alcohols are C1 to C18 alcohols and may be either linear or branched. Suitable alcohols include, but are not limited to, butanol, hexanol, dodecanol, 2-ethylhexanol, and propylheptanol. Specific examples of the ester base oil that may be included in the lubricant composition include, but are not limited to, dibutyl adipate, di(2-ethylhexyl) sebacate, di-n-hexyl fumarate, dioctyl sebacate, diisooctyl azelate, diisodecyl azelate, dioctyl phthalate didecyl phthalate, dieicosyl sebacate, the 2-ethylhexyl diester of linoleic acid dimer, and the dipropylheptanol diester of adipic acid.

When the lubricant composition includes the ester, the ester is typically present in an amount of from about 5 to about 35, from about 10 to about 30, or from about 15 to about 25, parts by weight based on 100 parts by weight of the lubricant composition.

In one embodiment, the lubricant composition includes a dipropylheptanol diester of adipic acid in an amount of from about 15 to about 25 parts by weight, the third polyalkylene glycol in an amount of from about 10 to about 35 parts by weight, and the fourth polyalkylene glycol in an amount of from about 45 to about 75 parts by weight, each based on 100 parts by weight of the lubricant composition. In this embodiment, the third polyalkylene glycol has a kinematic viscosity at 100° C. of from about 2 to about 10 cSt and a kinematic viscosity at 40° C. of from about 15 to about 35 cSt. In addition, the fourth polyalkylene glycol has a kinematic viscosity at 100° C. of from about 15 to about 35 cSt and a kinematic viscosity at 40° C. of from about 80 to about 160 cSt. Moreover, in this embodiment, both the third and forth polyalkylene glycols are homopolymers formed from propylene oxide. Moreover, in this embodiment, the lubricant composition is generally used to lubricant an axle, transmissions (manual or automatic), transfer cases, transaxles, power take off (PTO), and/or bearings/wheels of a vehicle while achieving increased fuel efficiency for the vehicle. Without being held to any particular theory, it is believed that the combination of the third and fourth polyalkylene glycols produce the increased fuel efficiency. More specifically, it is believed that the combination of the chemistry and the kinematic viscosity of the blend of the third and fourth polyalkylene glycols impart excellent low and high temperature properties to the lubricant composition, which increases the fuel efficiency of the lubricant composition when the lubricant composition is used to lubricate the above referenced components of the vehicle.

In certain embodiments, the lubricant composition exhibits improved fuel efficiency in comparison to conventional lubricants. This increased fuel efficiency can be observed when the lubricant composition is analyzed with a Minimum Traction Machine (MTM) under Stribeck conditions and Slide-Roll Ratio (SRR) at 40° C. and 100° C. In certain embodiments, the lubricant composition has a traction coefficient of less than 0.030 when measured under Stribeck conditions, at a speed of 1,000 mm/s, and at a temperature of 40° C. Without being bound to any particular theory, it is believed that the amount of the polyalkylene glycol base oil component and its kinematic viscosity at 40° C. and 100° C. produces a lubricant composition having improved fuel efficiency. In particular it is believed that polyalkylene glycol base oil component imparts excellent low and high temperature properties to the lubricant composition, which increases the fuel efficiency of the lubricant composition when the lubricant composition is used to lubricate an axle, transmissions (manual or automatic), transfer cases, transaxles, power take off (PTO), and/or bearings/wheels of a vehicle. This increased fuel efficiency is demonstrated by the traction coefficients of the lubricant composition described above. In addition, despite demonstrating increased fuel efficiency, the lubricant composition also has good shear stability and oxidation resistance, among other properties. Moreover, the lubricant composition also allows exhibits improved (i.e., lower) operating temperatures in comparison to conventional lubricants due to the fact that heat generated from friction is minimized as evidenced by the comparatively lower traction coefficient.

In one embodiment, the lubricant composition is an axle lubricant. In this embodiment, the polyalkylene glycol base oil component is water-soluble and present in an amount of at least about 80 parts by weight based on 100 parts by weight of the axle lubricant. Typically, in this embodiment, the polyalkylene glycol base oil component is present in an amount of about 80 to about 95, parts by weight based on 100 parts by weight of the axle lubricant. The polyalkylene glycol base oil component includes the first polyalkylene glycol in an amount of from about 50 to about 85 parts by weight based on 100 parts by weight of the axle lubricant. The first polyalkylene glycol has a kinematic viscosity at 100° C. of from about 2 to about 30 cSt and a kinematic viscosity at 40° C. of from about 10 to about 50 cSt. The polyalkylene glycol base oil component further includes the second polyalkylene glycol in an amount of from about 5 to about 35 parts by weight based on 100 parts by weight of the axle lubricant. The second polyalkylene glycol has a kinematic viscosity at 100° C. of from about 120 to about 200 cSt, and a kinematic viscosity at 40° C. of from about 800 to about 1,200 cSt. The combination of the first and second polyalkylene glycols produces the axle lubricant having a kinematic viscosity at 100° C. of from about 4 to about 50 cSt, a kinematic viscosity at 40° C. of from about 20 to about 300 cSt, and a viscosity index of from about 170 to about 250. Moreover, the axle lubricant of this embodiment is also essentially free of Type I, II, III, and IV base oils. Although not required, the axle lubricant of this embodiment may also consist essentially of the components described above and the additive package described below. Without being bound to any particular theory, it is believed that the axle lubricant of this embodiment increases the fuel efficiency of a vehicle when used to lubricate the axle of the vehicle. More specifically, it is believed that the combination of the chemistry and the kinematic viscosity of the blend of the first and second polyalkylene glycols impart excellent low and high temperature properties to the lubricant composition, which increases the fuel efficiency of the lubricant composition when the lubricant composition is used to lubricate an axle of a vehicle.

In other embodiments, the lubricant composition is a transmission lubricant, a transfer case lubricant, a transaxle lubricant, a power take off lubricant, and/or a bearing/wheel lubricant. In these embodiments, the polyalkylene glycol base oil component is water-soluble and present in an amount of at least about 80 parts by weight based on 100 parts by weight of the axle lubricant. Typically, in these embodiments, the polyalkylene glycol base oil component is present in an amount of about 80 to about 95, parts by weight based on 100 parts by weight of the lubricant composition. The polyalkylene glycol base oil component includes the first polyalkylene glycol in an amount of from about 50 to about 85 parts by weight based on 100 parts by weight of the lubricant composition. The first polyalkylene glycol has a kinematic viscosity at 100° C. of from about 2 to about 30 cSt and a kinematic viscosity at 40° C. of from about 10 to about 50 cSt. The polyalkylene glycol base oil component further includes the second polyalkylene glycol in an amount of from about 5 to about 35 parts by weight based on 100 parts by weight of the lubricant composition. The second polyalkylene glycol has a kinematic viscosity at 100° C. of from about 120 to about 200 cSt, and a kinematic viscosity at 40° C. of from about 800 to about 1,200 cSt. The combination of the first and second polyalkylene glycols produces the lubricant composition having a kinematic viscosity at 100° C. of from about 4 to about 50 cSt, a kinematic viscosity at 40° C. of from about 20 to about 300 cSt, and a viscosity index of from about 170 to about 250. Moreover, the lubricant composition of these embodiments is also essentially free of Type I, II, III, and IV base oils. Although not required, the lubricant composition of these embodiments may also consist essentially of the components described above and the additive package described below. Without being bound to any particular theory, it is believed that the lubricant composition of these embodiments increases the fuel efficiency of a vehicle when used to lubricate transmissions (manual or automatic), transfer cases, transaxles, power take offs, and/or bearings/wheels of the vehicle. More specifically, it is believed that the combination of the chemistry and the kinematic viscosity of the blend of the first and second polyalkylene glycols impart excellent low and high temperature properties to the lubricant composition, which increases the fuel efficiency of the lubricant composition when the lubricant composition is used to lubricate transmissions (manual or automatic), transfer cases, transaxles, power take offs, and/or bearings/wheels of a vehicle.

The lubricating composition may also include an additive package. The additive package includes at least one additive effective to improve at least one property of the lubricant composition and/or the performance of the equipment in which the lubricant composition is to be used. In certain embodiments, the additive package includes one or more additives chosen from antioxidants, corrosion inhibitors, foam control additives, extreme pressure additives, anti-wear additives, detergents, metal passivators, pour point depressant, and viscosity index improvers. Although not required, the additive package and the lubricant composition are generally essentially free of dispersants. In certain embodiments, the additive package, or a portion of the additive package, is commercially available from Afton Chemical under the tradename HITEC® 350.

It is to be appreciated that the individual additives included in the additive package may be combined with one or more other additives prior to being added to the lubricant composition, or in the alternative, the individual additives may be separately added to the lubricant composition. In other words, the additive package does not require that all, or even a portion, of the additives be combined prior to being combined with the polyalkylene glycol base oil component.

When the lubricant composition includes the additive package, the additive package is typically present in an amount of from about 2 to about 20, from about 4 to about 18, from about 4 to about 16, from about 4 to about 14, or from about 6 to about 12, parts by weight based on 100 parts by weight of the lubricant composition.

In regards to the anti-wear additive, any anti-wear additive known in the art may be included. Suitable, non-limiting examples of the anti-wear additive include zinc dialkyldithio phosphate ("ZDDP"), zinc dialkyl-dithio phosphates, sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio] propionate, triphenyl thiophosphate (triphenylphosphorothioate), tris(alkylphenyl) phosphorothioate and mixtures thereof (for example tris(isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis (2-ethylhexyl)aminomethyl]-2-mercapto-1H-1,3-benzothiazole, ethoxycarbonyl-5-octyldithio carbamate, ashless anti-wear additives including phosphorous, and/or combinations thereof. In one embodiment, the anti-wear additive is ZDDP.

If included, the anti-wear additive may be included in the lubricant composition in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, parts by weight based on 100 parts by weight of the lubricant composition. The amount of anti-wear additive may vary outside of the ranges above, but is typically both whole and fractional values within these ranges. Further, it is to be appreciated that more than one anti-wear additive may be included in the lubricant composition, in which case the total amount of all the anti-wear additive included is within the above ranges. Further, it is to be appreciated that more than anti-wear additive may be included in the lubricant composition, in which case the total amount of all the anti-wear additives included is within the above ranges.

Similarly, any pour point depressant known in the art may be included. The pour point depressant is typically selected from polymethacrylate and alkylated naphthalene derivatives, and combinations thereof.

If included, the pour point depressant may be included in the lubricant composition in an amount of from about 0.01 to about 5, alternatively from about 0.01 to about 2, alternatively from about 0.01 to about 1, alternatively from about 0.01 to about 0.5, parts by weight based on 100 parts by weight of the lubricant composition. The amount of pour point depressant may vary outside of the ranges above, but is typically both whole and fractional values within these ranges. Further, it is to be appreciated that more than one pour point depressant may be included in the lubricant composition, in which case the total amount of all the pour point depressant included is within the above ranges.

In regards to the antifoam agent, any antifoam agent known in the art may be included. The antifoam agent is typically selected from silicone antifoam agents, acrylate copolymer antifoam agents, and combinations thereof.

If included, the antifoam agent may be included in the lubricant composition in an amount of from about 1 to about 1000, alternatively from about 1 to about 500, alternatively from about 1 to about 400, ppm based on the total weight of the lubricant composition. The amount of antifoam agent may vary outside of the ranges above, but is typically both whole and fractional values within these ranges. Further, it is to be appreciated that more than one antifoam agent may be included in the lubricant composition, in which case the total amount of all the antifoam agent included is within the above ranges.

If included, the detergent is typically selected from overbased or neutral metal sulfonates, phenates and salicylates, and combinations thereof. For example, in various embodiments, the detergent is selected from metal sulfonates, phenates, salicylates, carboxylates, thiophosphonates, and combinations thereof. In one embodiment, the detergent includes an overbased metal sulfonate, such as calcium sulfonate. In another embodiment, the detergent includes an overbased metal salicylate, such as calcium metal salicylate. In yet another embodiment, the detergent includes an alkyl phenate detergent.

If employed, the detergent may be included in the lubricant composition in an amount of from about 0.1 to about 35, alternatively of from about 0.1 to about 5, from about 0.1 to about 3, or from about 0.1 to about 1, parts by weight based on 100 parts by weight of the lubricant composition. The amount of detergent may vary outside of the ranges above, but is typically both whole and fractional values within these ranges. Further, it is to be appreciated that more than one detergent may be included in the lubricant composition, in which case the total amount of all the detergent included is within the above ranges.

If employed, the viscosity index improver can be of various types. Suitable examples of viscosity index improvers include polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the viscosity index improver can be used in various amounts. The viscosity index improver may be present in the lubricant composition in an amount of from about 0.01 to about 5, from about 0.1 to about 3, or from about 0.1 to about 1, parts by weight based on 100 parts by weight of the lubricant composition. The amount of viscosity index improver may vary outside of the ranges above, but is typically both whole and fractional values within these ranges. Further, it is to be appreciated that more than one viscosity index improver may be included in the lubricant composition, in which case the total amount of all the viscosity index improver included is within the above ranges.

If employed, the antioxidant can be of various types. Suitable antioxidants include alkylated monophenols, alkylthiomethylphenols, hydroquinones and alkylated hydroquinones, hydroxylated thiodiphenyl ethers, alkylidenebisphenols, O-, N- and S-benzyl compounds, hydroxybenzylated malonates, triazine compounds, aromatic hydroxybenzyl compounds, benzylphosphonates, acylaminophenols, Esters of [3-(3,5-di-tert-butyl-4-hydroxyphenyl)propionic acid with mono- or polyhydric alcohols, esters of β-(5-tert-butyl-4-hydroxy-3-methylphenyl)-propionic acid with mono- or polyhydric alcohols, aminic antioxidants, aliphatic or aromatic phosphites, esters of thiodipropionic acid or of thiodiacetic acid, salts of dithiocarbamic or dithiophosphoric acid, 2 sulfurized fatty esters, sulfurized fats and sulfurized olefins, and combinations thereof, may be used.

If included, the antioxidant can be used in various amounts. The antioxidant is typically present in the lubricant composition in an amount ranging of from about 0.01 to about 5, of from about 0.1 to about 3, or of from about 0.5 to about 2, parts by weight based on 100 parts by weight of the lubricant composition.

The present disclosure also provides a method of increasing the fuel efficiency of a vehicle having an axle. The method includes providing the lubricant composition. The method further includes contacting the lubricant composition with the axle of the vehicle to increase the fuel efficiency of the vehicle.

The present disclosure also provides a method of increasing the fuel efficiency of a vehicle having an axle, transmissions (manual or automatic), transfer cases, transaxles, power take off (PTO), and/or bearings/wheels of a vehicle. The method includes providing the lubricant composition. The method further includes contacting the lubricant composition with at least one component of the vehicle chosen from the group of transmissions (manual or automatic), transfer cases, transaxles, power take offs, bearings/wheels, and combinations thereof to increase the fuel efficiency of the vehicle.

In one embodiment, the method of the disclosure includes providing the axle lubricant to increase the fuel efficiency of a vehicle having an axle. In this embodiment, the polyalkylene glycol base oil component of the axle lubricant is present in an amount of at least about 60 parts by weight based on 100 parts by weight of the axle lubricant. In addition, the axle lubricant has a kinematic viscosity at 100° C. of from about 5 to about 35 cSt and a kinematic viscosity at 40° C. of from about 20 to about 300 cSt. Moreover, the axle lubricant also has a traction coefficient of less than 0.030 when measured under Stribeck conditions, at a speed of 1,000 mm/s, and at a temperature of 100° C. The method further includes contacting the lubricant and the axle of the vehicle with the axle lubricant to increase the fuel efficiency of the vehicle.

EXAMPLES

Two lubricant compositions within the scope of this disclosure are provided in Table 1 as Lubricant Compositions 1 and 2. Table 1 also provides two comparative lubricants as Comparative Lubricants A and B. Each individual component for each lubricant in Table 1 is provided in parts by weight based on 100 parts by weight of the respective lubricant.

TABLE 1

| | Lubricant Composition 1 | Lubricant Composition 2 | Comparative Lubricant A | Comparative Lubricant B |
|---|---|---|---|---|
| Base oil 1 | 80.5 | — | — | — |
| Base oil 2 | 19.5 | — | — | — |
| Base oil 3 | — | 20.6 | — | — |
| Base oil 4 | — | 59.8 | — | — |
| Base oil 5 | — | 19.6 | — | — |
| Base oil 6 | — | — | 50.8 | — |
| Base oil 7 | — | — | 49.2 | — |
| Base oil 8 | — | — | — | 76.0 |
| Base oil 9 | — | — | — | 24 |
| Kinematic Vis (100° C.) | 12.31 | 12.37 | 11.81 | 11.97 |
| Kinematic Vis (40° C.) | 54.78 | 62.65 | 104.6 | 75.44 |
| Viscosity Index | 230 | 200 | 101 | 154 |

Base Oil 1 is a water-soluble copolymer of ethylene oxide and propylene oxide, having a kinematic viscosity at 100° C. of about 2 to about 10 cSt and a kinematic viscosity at 40° C. of about 15 to about 25 cSt.

Base Oil 2 is a water-soluble copolymer of ethylene oxide and propylene oxide, having a kinematic viscosity at 100° C. of about 120 to about 200 cSt and a kinematic viscosity at 40° C. of about 900 to about 1,000 cSt.

Base Oil 3 is a water-insoluble homopolymer of propylene oxide, having a kinematic viscosity at 100° C. of about 2 to about 10 cSt and a kinematic viscosity at 40° C. of about 30 to about 40 cSt.

Base Oil 4 is a water-insoluble homopolymer of propylene oxide, having a kinematic viscosity at 100° C. of about 15 to about 25 cSt and a kinematic viscosity at 40° C. of about 115 to about 140 cSt.

Base oil 5 is a diester of 2-propylheptanol and adipic acid.

Base oil 6 is a group I base oil commercially available from ExxonMobil under the tradename Americas CORE 150™.

Base oil 7 is a group I base oil commercially available from ExxonMobil under the tradename Americas CORE 2550™.

Base oil 8 is a polyalphaolefin base oil commercially available from ExxonMobil having a kinematic viscosity at 100° C. of 6 cSt.

Base oil 9 is a polyalphaolefin base oil commercially available from ExxonMobil having a kinematic viscosity at 100° C. of 100 cSt.

The kinematic viscosity and viscosity index of Lubricant Compositions 1-2 and Comparative Lubricants A-B were measured and are also provided in Table 1.

Figure 1B:
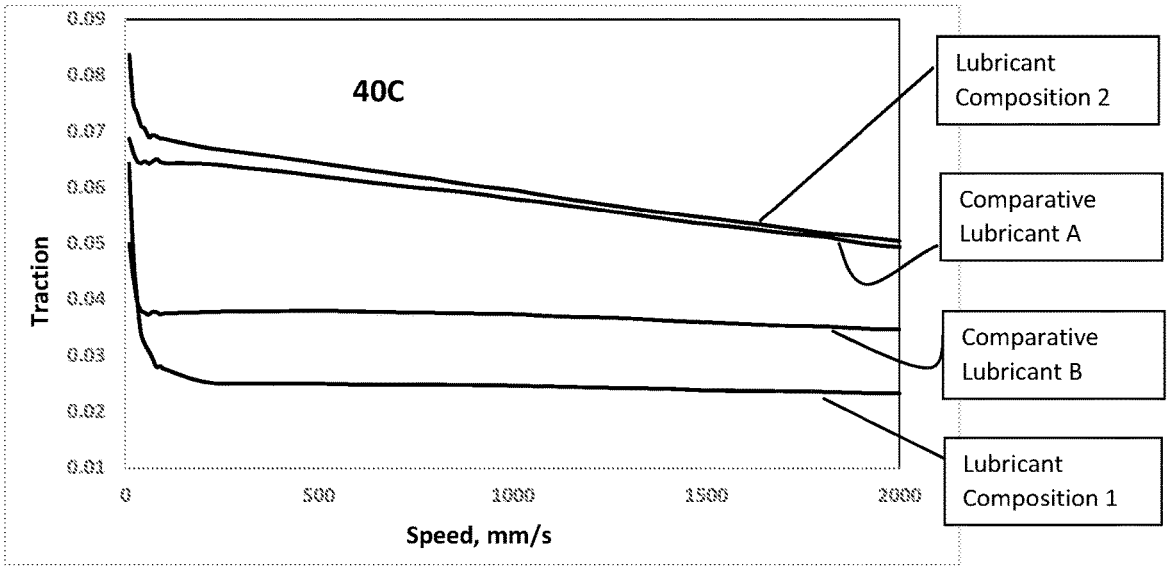
FIG. 1B is another line graph illustrating traction coefficient data for certain embodiments of the lubricant composition.

The traction coefficient were measured with a MTM under Stribeck conditions, at a temperature of 100° C. and also at a temperature of 40° C. The results at 100° C. and 40° C. are provided in FIGS. 1A and 1B, respectively.

The results demonstrate that Lubricant Compositions 1 and 2 have excellent fuel efficiency.

Two additional lubricant compositions within the scope of this disclosure are provided in Table 2 as Lubricant Compositions 3 and 4. Also provided in Table 2 is a comparative lubricant as Comparative Lubricant C. Each individual component for each lubricant is provided in parts by weight based on 100 parts by weight of the respective composition.

TABLE 2

| | Lubricant Composition 3 | Lubricant Composition 4 | Comparative Lubricant C |
|---|---|---|---|
| Base oil 1 | 74.1 | — | — |
| Base oil 2 | 18 | — | — |
| Base oil 3 | — | 19 | — |
| Base oil 4 | — | 55 | — |
| Base oil 5 | — | 18 | 15 |
| Base oil 8 | — | — | 42.5 |
| Base oil 10 | — | — | 28.6 |
| Performance Additives | 7.9 | 8 | 13.9 |
| Kinematic Vis (100° C.) | 12.11 | 12.2 | 6.45 |
| Kinematic Vis (40° C.) | 54.95 | 63.61 | 27.98 |
| Viscosity Index | 224 | 193 | 196 |
| Brookfield Viscosity −40° C., cP | 39,800 | 89,400 | 16,100 |
| Pour Point, ° C. | −60 | −54 | −60 |

Base oils 1-5 and 8 are as described above.

Base oil 10 is a metallocene catalyzed polyalphaolefin base oil commercially available from ExxonMobil having a kinematic viscosity at 100° C. of 150 cSt.

The performance additives include the performance additives described above.

Physical properties of Lubricant Compositions 3-4, and Comparative Lubricant C are also provided in Table 2.

Figure 2A:
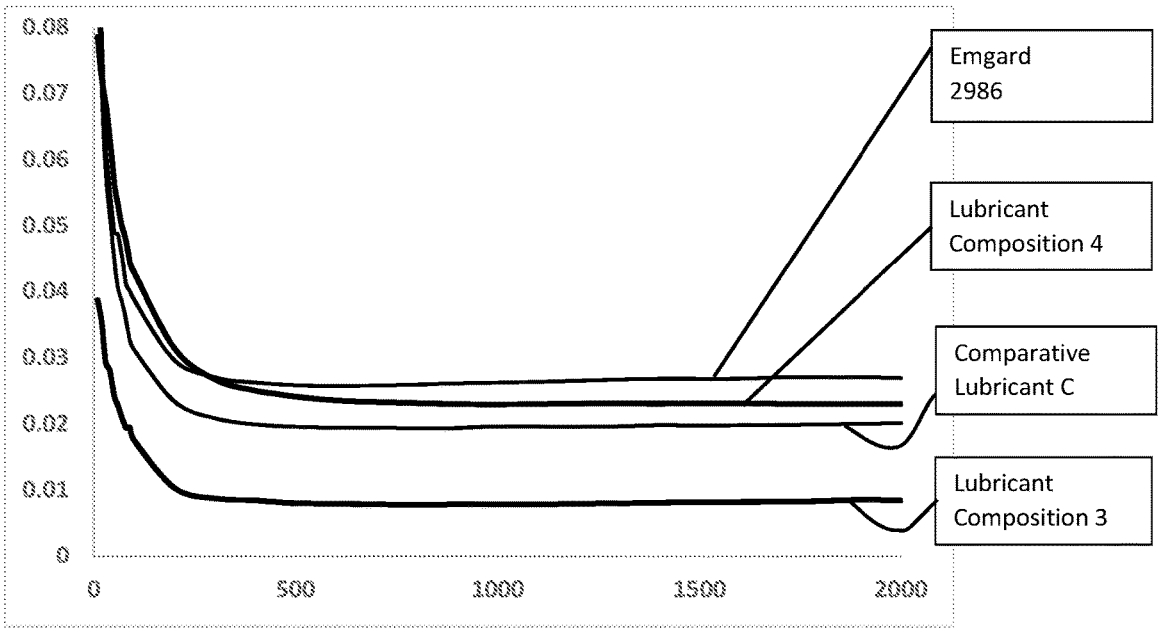
FIG. 2A is another line graph illustrating traction coefficient data for certain embodiments of the lubricant composition.
Figure 2B:
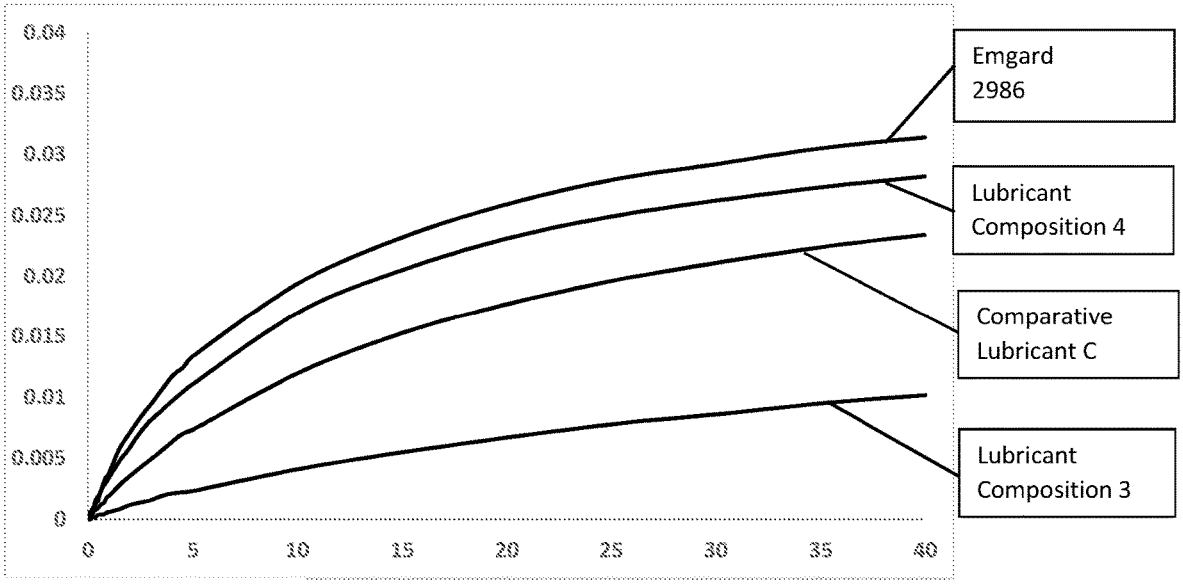
FIG. 2B is another line graph illustrating traction coefficient data for certain embodiments of the lubricant composition.

The traction coefficients for Lubricant Compositions 3-4, Comparative Lubricant C, and Emgard 2986 were measured under Stribeck conditions and Slide-Roll conditions. Emgard 2986 is a commercially available lubricant and was included for the purpose of providing an additional Comparative Lubricant. First, the traction coefficients were measured with a MTM under Stribeck conditions, at a temperature of 100° C. The results for this first traction coefficient test at 100° C. are provided in FIG. 2A. Second, the traction coefficients were measured with a MTM under Slide-Roll ratio conditions and at a temperature of 100° C. The results for this second traction coefficient test are provided in FIG. 2B. As shown in FIGS. 2A and 2B, Lubricant Compositions 3 and 4 have excellent fuel efficiency.

Figure 3A:
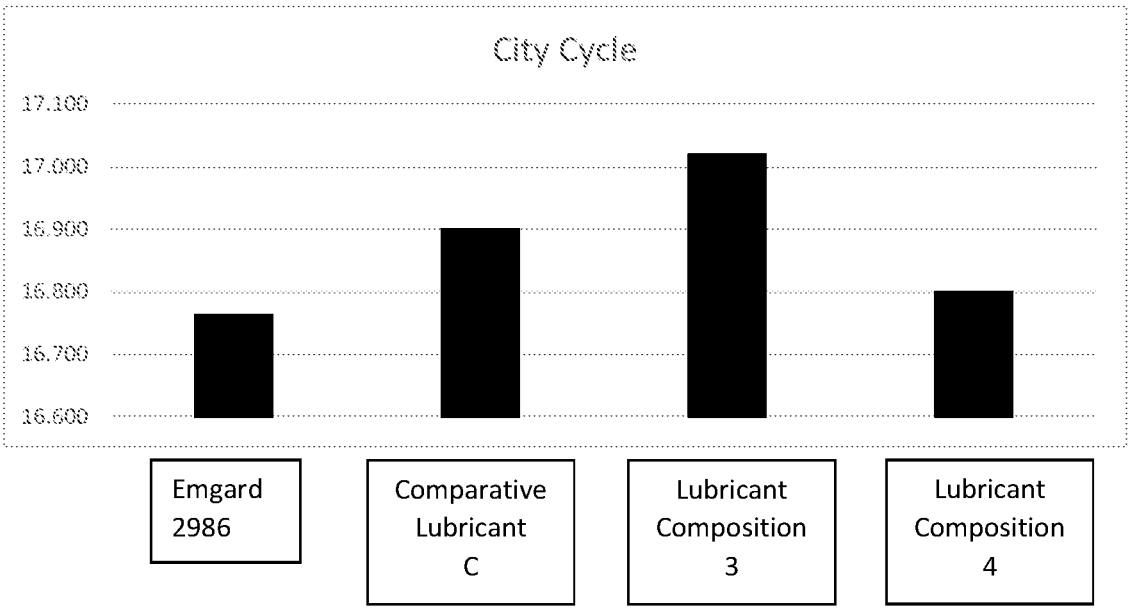
FIG. 3A is a bar graph illustrating fuel efficiency data for certain embodiments of the lubricant composition.
Figure 3B:
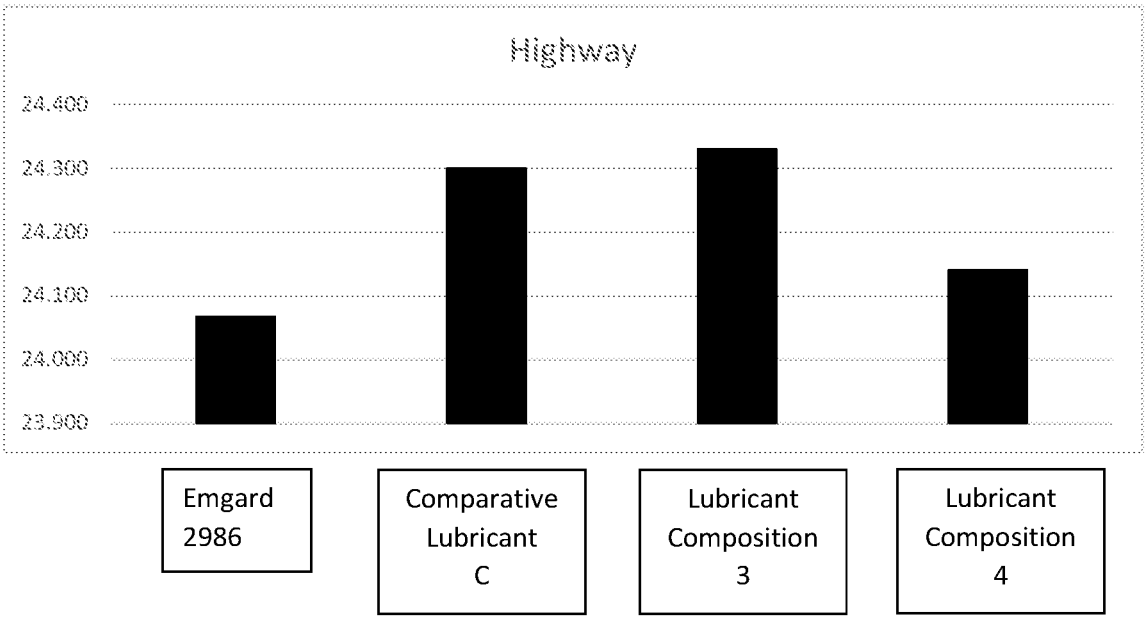
FIG. 3B is another bar graph illustrating fuel efficiency data for certain embodiments of the lubricant composition.
Figure 3C:
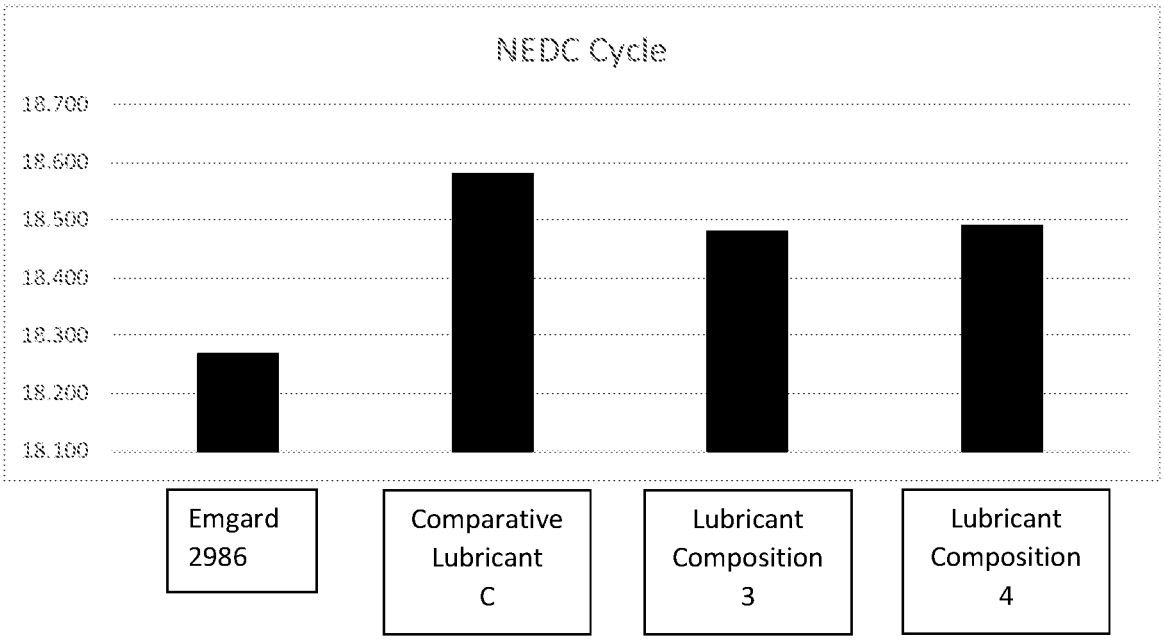
FIG. 3C is another bar graph illustrating fuel efficiency data for certain embodiments of the lubricant composition.

The fuel efficiency of Lubricant Compositions 3-4, Comparative Lubricant C, and Emgard 2986 were also evaluated using EPA 75/25 (city cycle and highway cycle) fuel economy and European NEDC cycle tests. These tests were both run on a chassis dynamometer using a 2015 Dodge Ram truck (C 235 axle). The results are provided in FIGS. 3A, 3B, and 3C. As shown in FIGS. 3A-3C, Lubricant Compositions 3 and 4 have excellent fuel efficiency.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims. Moreover, the selection of the solvent(s), amount of solvent(s), the choice of polycarboxylate, and both the choice of alkalinity builder(s) and particle size of the alkalinity builder and other solid raw materials, contained within the Formulations generally manipulates the viscosity of the Formulation.

The present disclosure has been described in an illustrative manner, and it is to be understood that the terminology which has been used is intended to be in the nature of words of description rather than of limitation. Many modifications and variations of the present disclosure are possible in light of the above teachings. The present disclosure may be practiced otherwise than as specifically described. The subject matter of all combinations of independent and dependent claims, both singly and multiply dependent, is herein expressly contemplated.

What is claimed is:

1. A lubricant composition comprising a polyalkylene glycol base oil component in an amount of at least about 60 parts by weight based on 100 parts by weight of said lubricant composition, wherein the polyalkylene glycol base oil component comprises a first polyalkylene glycol having a kinematic viscosity at 40° C. of from about 5 to about 50 cSt, measured in accordance with ASTM D445, wherein said lubricant composition has a kinematic viscosity at 100° C. of from about 4 to about 50 cSt and a kinematic viscosity at 40° C. of from about 20 to about 260 cSt, each measured in accordance with ASTM D445, wherein said lubricant composition has a viscosity index of from about 190 to about 230 as measured in accordance with ASTM D2270, and wherein said lubricant composition exhibits a traction coefficient of less than 0.030 when measured under Stribeck conditions, at a speed of 1,000 mm/s, and at a temperature of 100° C.

2. The lubricant composition as set forth in claim 1 wherein said polyalkylene glycol base oil component is water-soluble.

3. The lubricant composition as set forth in claim 2, wherein the first polyalkylene glycol has a kinematic viscosity at 100° C. of from about 2 to about 70 cSt and a kinematic viscosity at 40° C. of from about 5 to about 50 cSt, each measured in accordance with ASTM D445, and wherein said polyalkylene glycol base oil component further comprises a second polyalkylene glycol having a kinematic viscosity at 100° C. of from about 50 to about 220 cSt and a kinematic viscosity at 40° C. of from about 150 to about 1,300 cSt, each measured in accordance with ASTM D445, and wherein said second polyalkylene glycol has a kinematic viscosity that is greater than the kinematic viscosity of said first polyalkylene glycol at 100° C. and 40° C.

4. The lubricant composition as set forth in claim 3 wherein;

said first polyalkylene glycol has a kinematic viscosity at 100° C. of from about 2 to about 30 cSt and a kinematic viscosity at 40° C. of from about 10 to about 40 cSt, each measured in accordance with ASTM D445, and said second polyalkylene glycol has a kinematic viscosity at 100° C. of from about 120 to about 200 cSt and a kinematic viscosity at 40° C. of from about 800 to about 1,200 cSt, each measured in accordance with ASTM D445.

5. The lubricant composition as set forth in claim 3 wherein said polyalkylene glycol base oil component comprises said first polyalkylene glycol in an amount of from about 50 to about 85 parts by weight based on 100 parts by weight of said lubricant composition.

6. The lubricant composition as set forth in claim 3 wherein at least one of said first and second polyalkylene glycols is a random copolymer formed from the reaction product of ethylene oxide and propylene oxide.

7. The lubricant composition as set forth in claim 2 having a traction coefficient of less than 0.020 when measured under Stribeck conditions, at a speed of 1,000 mm/s, and at a temperature of 40° C.

8. The lubricant composition as set forth in claim 1 wherein said polyalkylene glycol base oil component is water-insoluble.

9. The lubricant composition as set forth in claim 8, wherein said first polyalkylene glycol has a kinematic viscosity at 100° C. of from about 2 to about 15 cSt and a kinematic viscosity at 40° C. of from about 15 to about 50 cSt, each measured in accordance with ASTM D445, and a fourth polyalkylene glycol having a kinematic viscosity at 100° C. of from about 10 to about 50 cSt and a kinematic viscosity at 40° C. of from about 60 to about 250 cSt, each measured in accordance with ASTM D445, wherein said fourth polyalkylene glycol has a kinematic viscosity that is greater than the kinematic viscosity of said first polyalkylene glycol at 100° C. and 40° C.

10. The lubricant composition as set forth in claim 9 wherein:

said first polyalkylene glycol has a kinematic viscosity at 100° C. of from about 2 to about 10 cSt and a kinematic viscosity at 40° C. of from about 20 to about 50 cSt, each measured in accordance with ASTM D445, and said fourth polyalkylene glycol has a kinematic viscosity at 100° C. of from about 15 to about 35 cSt and a kinematic viscosity at 40° C. of from about 80 to about 160 cSt, each measured in accordance with ASTM D445.

11. The lubricant composition as set forth in claim 9 wherein said polyalkylene glycol base oil component comprises:

said first polyalkylene glycol in an amount of from about 5 to about 40 parts by weight based on 100 parts by weight of said polyalkylene glycol base oil component, and said fourth polyalkylene glycol in an amount of from about 40 to about 70 parts by weight based on 100 parts by weight of said polyalkylene glycol base oil component.

12. The lubricant composition as set forth in claim 9 wherein at least one of said third and fourth polyalkylene glycols is a homopolymer formed from propylene oxide.

13. The lubricant composition as set forth in claim 1 further comprising a diester.

14. The lubricant composition as set forth in claim 1 further comprising an additive package containing at least one additive chosen from antioxidants, corrosion inhibitors, foam control additives, extreme pressure additives, anti-wear additives, detergents, and viscosity index improvers, wherein said lubricant composition is essentially free of dispersants.

15. The lubricant composition as set forth in claim 1 being essentially free of Type I, II, III, and IV base oils.

16. The lubricant composition as set forth in claim 1 wherein said lubricant composition is an axle lubricant.

17. An axle lubricant comprising:

a polyalkylene glycol base oil component that is water-soluble and present in an amount of at least about 80 parts by weight based on 100 parts by weight of said axle lubricant, said polyalkylene glycol base oil component comprising;

a first polyalkylene glycol in an amount of from about 50 to about 85 parts by weight based on 100 parts by weight of said axle lubricant with said first polyalkylene glycol having a kinematic viscosity at 100° C. of from about 2 to about 30 cSt and a kinematic viscosity at 40° C. of from about 10 to about 50 cSt, each measured in accordance with ASTM D445, and a second polyalkylene glycol in an amount of from about 5 to about 35 parts by weight based on 100 parts by weight of said axle lubricant with said second polyalkylene glycol having a kinematic viscosity at 100° C. of from about 120 to about 200 cSt and a kinematic viscosity at 40° C. of from about 800 to about 1,200 cSt, each measured in accordance with ASTM D445;

wherein said axle lubricant has a kinematic viscosity at 100° C. of from about 4 to about 50 cSt and a kinematic viscosity at 40° C. of from about 20 to about 260 cSt, each measured in accordance with ASTM D445;

wherein said axle lubricant is essentially free of Type I, II, III, and IV base oils;

wherein the axle lubricant has a traction coefficient of less than 0.030 when measured under Stribeck conditions, at a speed of 1,000 mm/s, and at a temperature of 100° C.; and wherein said axle lubricant has a viscosity index of from about 190 to about 230 as measured in accordance with ASTM D2270.

18. A method of increasing the fuel efficiency of a vehicle having an axle, said method comprising;

providing an axle lubricant comprising a polyalkylene glycol base oil component present in an amount of at least about 60 parts by weight based on 100 parts by weight of the axle lubricant;

wherein the polyalkylene glycol base oil component comprises a first polyalkylene glycol having a kinematic viscosity at 40° C. of from about 5 to about 50 cSt, measured in accordance with ASTM D445;

wherein the axle lubricant has a kinematic viscosity at 100° C. of from about 4 to about 50 cSt and a kinematic viscosity at 40° C. of from about 20 to about 260 cSt, each measured in accordance with ASTM D445;

wherein said lubricant composition has a viscosity index of from about 190 to about 230 as measured in accordance with ASTM D2270; and wherein the axle lubricant has a traction coefficient of less than 0.030 when measured under Stribeck conditions, at a speed of 1,000 mm/s, and at a temperature of 100° C.; and contacting the axle lubricant and the axle of the vehicle to increase the fuel efficiency of the vehicle.

* * * * *